US006814529B2

(12) United States Patent
Junge

(10) Patent No.: US 6,814,529 B2
(45) Date of Patent: Nov. 9, 2004

(54) TRANSPORT CONTAINER FOR UNIT GOODS

(75) Inventor: Klaus Junge, Berlin (DE)

(73) Assignee: friedola Gebr, Holzapef GmbH & Co. KG, Meinhard-Meinhard (DE)

( * ) Notice: Subject to any disclaimer, the term of this patent is extended or adjusted under 35 U.S.C. 154(b) by 0 days.

(21) Appl. No.: 10/266,314

(22) Filed: Oct. 7, 2002

(65) Prior Publication Data

US 2003/0190207 A1 Oct. 9, 2003

Related U.S. Application Data

(63) Continuation-in-part of application No. 10/162,971, filed on Jun. 5, 2002.

(30) Foreign Application Priority Data

Apr. 8, 2002 (DE) ..... 202 05 412

(51) Int. Cl.[7] ..... B60P 7/08

(52) U.S. Cl. ..... 410/46; 410/3; 410/7; 410/19; 410/30; 206/335; 206/600

(58) Field of Search ..... 410/3, 2, 30, 46, 410/97, 7, 19; 206/335, 386, 595, 596, 598, 599, 600, 505, 509, 511; 220/4.28; 108/53.1, 53.3, 54.1, 55.3; 224/924

(56) References Cited

U.S. PATENT DOCUMENTS 2,521,088 A * 9/1950 Phelps
2,579,685 A * 12/1951 Loose
2,909,349 A 10/1959 Morris
2,909,350 A 10/1959 Morris
3,355,029 A * 11/1967 Eurey
3,822,798 A * 7/1974 Neff
4,804,087 A * 2/1989 Smith
5,037,255 A * 8/1991 Bullock et al. ..... 410/30
5,593,259 A * 1/1997 Kuo ..... 410/3
5,775,858 A * 7/1998 Bacon ..... 410/26
6,065,914 A * 5/2000 Fotou ..... 410/3
6,331,094 B1 * 12/2001 Burrows ..... 410/30
6,558,093 B1 * 5/2003 Arnold et al. ..... 410/30
6,602,032 B2 * 8/2003 Arai ..... 410/46
2003/0141207 A1 * 7/2003 Pai
2003/0143051 A1 * 7/2003 Jackson ..... 410/3
2003/0150757 A1 * 8/2003 Dunn

FOREIGN PATENT DOCUMENTS

DE 83 00 764.4 6/1983
DE 91 13 312.2 2/1992

* cited by examiner

*Primary Examiner*—Stephen Gordon
(74) *Attorney, Agent, or Firm*—RatnerPrestia

(57) ABSTRACT

A transport container for unit goods, such as motorcycles, comprises a plastic base structure forming a base of the container; a plastic cover; columns; and a traction device or system. The columns are borne by the plastic base structure and bear the plastic cover and are connected in a positive lock to the plastic base structure and the plastic cover. The traction device or system tenses the plastic base structure and the plastic cover against the columns.

28 Claims, 10 Drawing Sheets

TRANSPORT CONTAINER FOR UNIT GOODS

Figure 1:
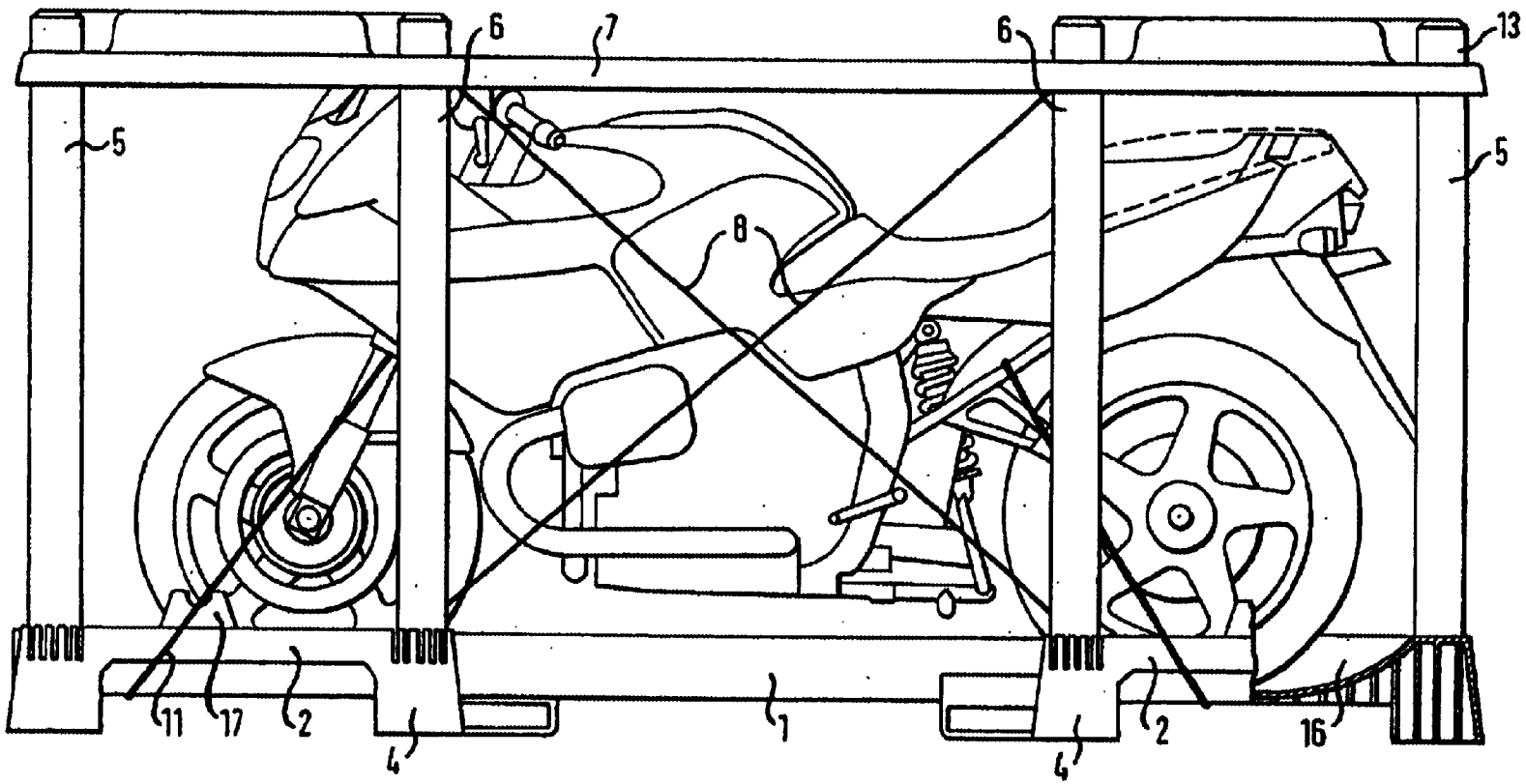

This application is a continuation-in-part of Ser. No. 10/162,971 filed Jun. 5, 2002.

The invention relates to a transport container for unit goods. In a preferred application, the container serves to transport cycles, in particular motorcycles.

Conventionally, cycles are transported in wooden casings which have to be put together especially and later painstakingly dismantled again.

This process holds the danger of accidents, it is not possible to re-use the casing, and disposing of it provides additional problems. In addition, import restrictions exist in many countries for wooden packaging, requiring special treatment.

A metal transport container for accommodating wound reels is known from DE 91 13 312 U1. It consists of a sub-frame and a bracket attached to it, each composed of square pipes. The sub-frame is formed as a rectangular frame in the manner of pallets, with capped longitudinal and transverse struts, and is underpinned by higher support bearers creating a free space towards the ground, such that the forks of a forklift truck can grip and handle the sub-frame. The sub-frame forms corner posts, into which the bracket is inserted. The bracket is composed of two side walls which each consist of two posts and a middle console connecting them to each other. A number of such containers can be stacked on top of one another. The structure is very complex in its entirety, and not least for this reason may have a considerable weight.

It is an object of the invention to provide a transport container for unit goods which has a low weight but is nonetheless stabile.

A transport container in accordance with the invention consists of at least a plastic base structure which forms the base of the container, a plastic cover, a number of columns and a bracing formed by a number of traction means. The base structure is preferably torsion-resilient and bend-resilient in its own right. It can for example be a plastic pallet, i.e. a structure jointed together from longitudinal and transverse struts and possibly other plastic parts. The cover can also be formed by a plastic pallet, which can be identical to the plastic pallet used for the base. More preferably, the plastic cover is manufactured from plastic by injection moulding or in another primary moulding process. The columns extend from the plastic base structure to the cover. They are borne by the plastic base structure, and in turn bear the cover. Furthermore, the columns are connected both to the plastic base structure and to the cover, in each case in a positive lock. The traction means are flexible in the sense that in practice they can only transfer traction forces. Thus, the traction means can be formed in particular by traction ropes, traction belts or traction bracings, though in principle also by other elongated, thin traction force transfer members. The already extant, positive-locking compound of the plastic base structure, the plastic cover and the columns is tensed using the traction means, and together with the traction means forms the bracings of a latticework which forms the transport container. To this end, the traction means or at least some of the traction means are diagonally tensed between two columns, preferably between two adjacent columns. In this way, the traction means form the diagonal bracings of the latticework between two columns. Each traction means is tensed between two fixing points. Essentially, a single traction means can be tensed from one fixing point to the next, next-but-one, etc. In this case as well, the term traction means in the sense illustrated directly above is used in the plural. The traction means are preferably each fixed in a first connection area, in which one of the columns and the plastic base structure are connected to each other in a positive lock, and in a second connection area, in which another of the columns and the plastic cover are connected to each other in a positive lock. By fixing in this way, nodes of a latticework are formed, in which each of the plastic base structure or the plastic cover, one of the columns and one of the traction means converge as the bracings of the latticework.

In preferred embodiments, the columns are also made of plastic. The columns are particularly preferably hollow profiles and can in particular be basic plastic pipes. Forming the columns as hollow profiles is also in particular advantageous for establishing the positive-lock connections at the ends of the columns, on the one hand to the plastic base structure and on the other to the plastic cover. Thus, the positive-lock connection can be established both by a neck bearing in the hollow cross-section of the respective column and, as in the case of columns made of solid material, by inserting the column in question into a hollow space formed on the plastic base structure and/or the plastic cover. The connection between the columns and the plastic base structure and/or the plastic cover is preferably not only a positive lock but additionally also a frictional lock. In a preferred embodiment, the columns are each connected both to the plastic base structure and to the plastic cover by way of a plug-in connection.

Designing the columns in accordance with the invention, such that they preferably extend freely between the plastic base structure and the cover, i.e. individually and without rigid transverse connections, and in particular are not connected to each other by heavy wall parts, saves on weight. High stability can nonetheless be achieved by way of the bracing using traction means which as a result tense the plastic base structure and the plastic cover against the columns and therefore towards each other. The invention utilises the fact that a latticework design such as is well known in other areas, for example in structural engineering, can also be usefully employed in designing a transport container, in order to obtain high stability in the transport container, for a comparatively low weight. Although the transport container formed as a latticework already exhibits excellent stability in its own right, the unit good to be transported, or the number of unit goods as the case may be, can also additionally be integrated into the latticework, in order to further increase the stability of the transport container including the unit good.

The plastic base structure is preferably a plastic pallet as set forth in U.S. patent application Ser. No. 10/162,971 by the Applicant. The disclosure content of this application for the plastic base structure of the transport container is hereby referenced. The fundamental idea of this older application is to form the plastic pallet from a plurality of plastic profiles, i.e. from hollow plastic profiles and plastic foot elements extending perpendicular to the hollow profiles. The hollow profiles and the foot elements are connected to each other by means of jointing connections. A welded connection is a preferred jointing connection. However, an adhesive connection, a screw connection or in particular a purely plug-in connection can also be advantageous. A combination of a plug-in connection and one of the other jointing connections is advantageous. As already disclosed in the older application, it is also preferably for the transport container in accordance with the invention if extrusion profiles form the hollow profiles and injection-moulded parts form the foot elements. By forming for example free-standing, i.e. projecting, standing feet for the foot elements and providing connecting extrusion profiles, the function and shaping process are combined in the plastic pallet.

In an alternative embodiment, the plastic base structure is formed by injection moulding, preferably as one piece. As appropriate, the base structure could for example also be obtained by mould-pressing.

Each of the traction means is preferably tensed diagonally between two columns directly adjacent to one another on one side of the plastic base structure and the plastic cover. Furthermore, it is particularly preferable for the traction means to be fixed to the plastic base structure and the plastic cover. One advantage of fixing in this way is that the columns can be formed as extrusion profiles, preferably without attachment parts. The cover and the plastic base structure can be formed with corresponding fixing means for the traction means, which is possible without any problems because the plastic base structure or at least foot elements of the base structure are preferably formed in a primary moulding process, in particular as injection-moulded parts. Other functional elements, for example plug-in elements for the columns, fixing elements for unit good lashing bracings, a wheel cavity for wheeled vehicles, in particular cycles, or receptacles or bearings for an axle, can also be integrated into such a shaping manufacturing process. This saves on subsequent attachments or installations. The plastic cover can also be formed as an injection-moulded part, such that in this case too corresponding fixing elements for the traction means can be formed without any problems, directly during original forming. In principle, the same advantages can be obtained by forming the plastic base structure as a whole or just the foot elements of the plastic base structure and/or the plastic cover by pressing and possibly subsequently sintering. The cover can also advantageously be formed by way of re-shaping, for example by embossing or deep-drawing.

Polypropylene is a preferred plastic material both for the plastic base structure and for the plastic cover and preferably also for the columns. The plastic parts can in particular be formed from a plastic regenerate, in particular the polypropylene cited.

Other, particularly preferred features are described in the sub-claims. Some of the sub-claims in particular describe a transport container which is in principle advantageous even without the bracing by means of the traction means in accordance with the invention. The Applicant therefore reserves the right to separately claim the embodiments described therein. The same applies to the plastic base structure and the plastic base structure. The Applicant therefore reserves the right to direct protection separately to the plastic base structure and wherein a transport container has its subject only in preferred developments.

Figure 2:
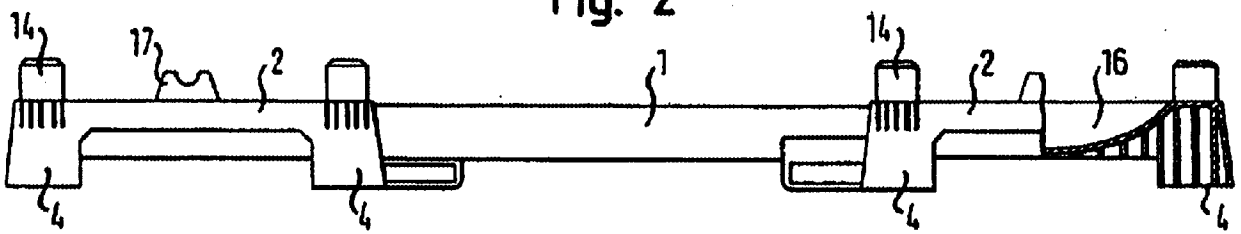
Figure 3:
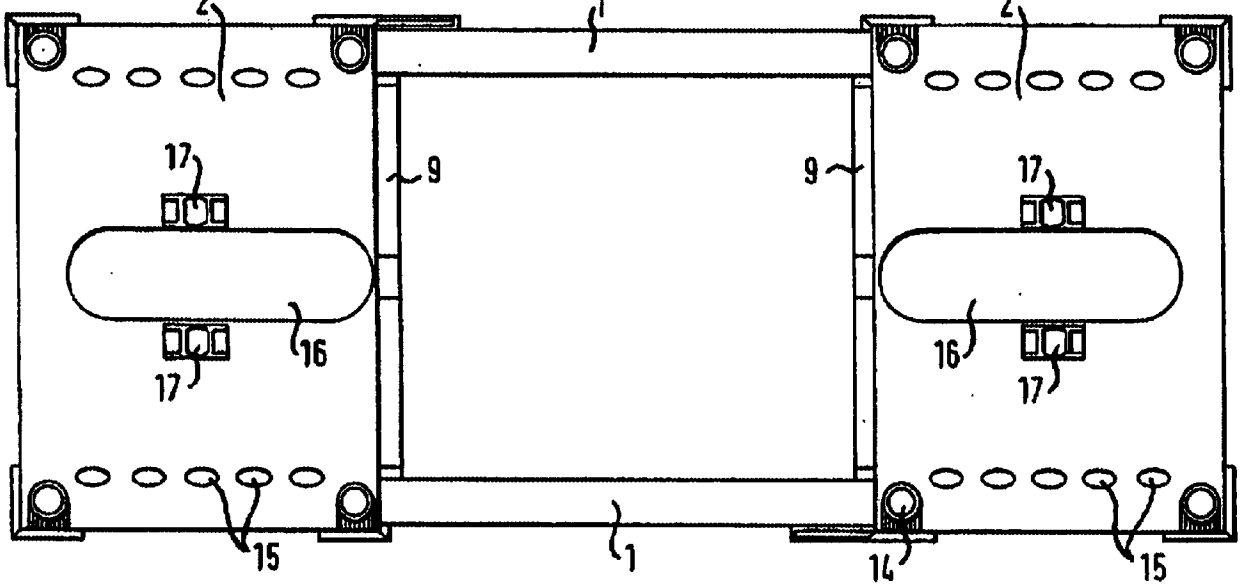
Figure 4:
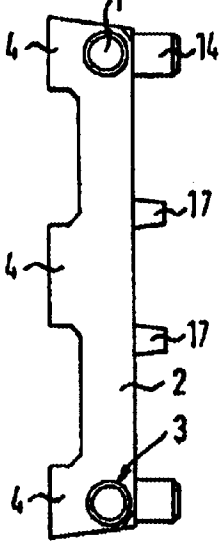
Figure 5:
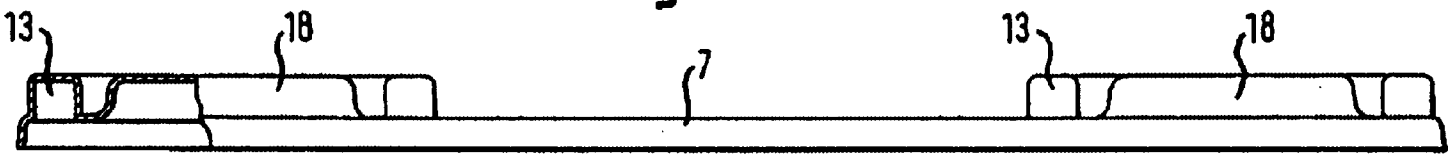

The invention will now be illustrated by way of an example embodiment. The features disclosed in the example embodiment, each individually and in any combination of features, advantageously develop the subject of the claims. There is shown:

FIG. 1 a transport container in a basic version;

FIG. 2 a plastic base structure forming the base of the transport container, in a side view;

FIG. 3 a top view of the plastic base structure in FIG. 2;

FIG. 4 the plastic base structure in a front view;

FIG. 5 a cover in a side view; and

Figure 6:
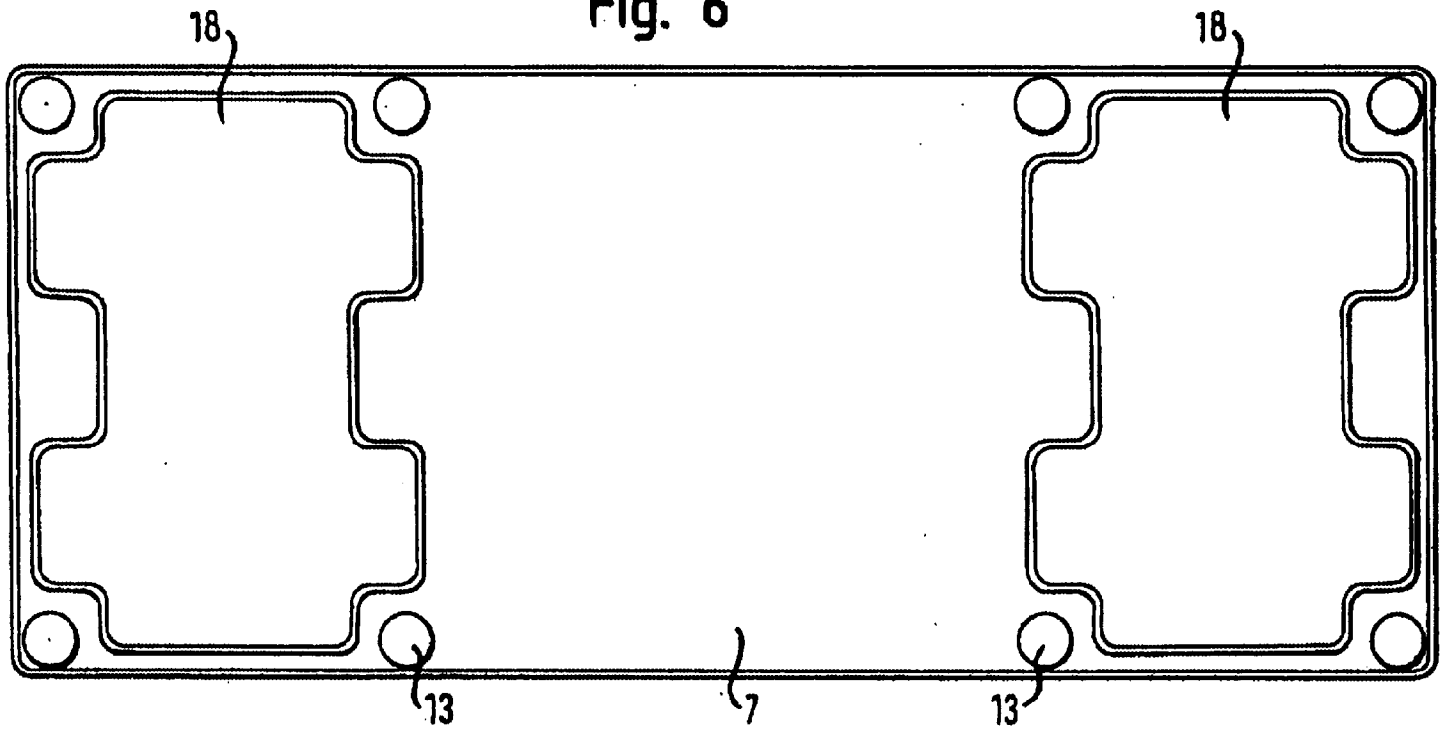
Figure 7:
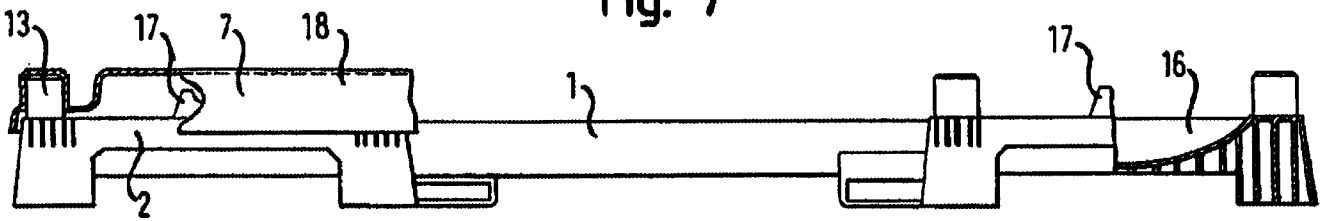
Figure 8:
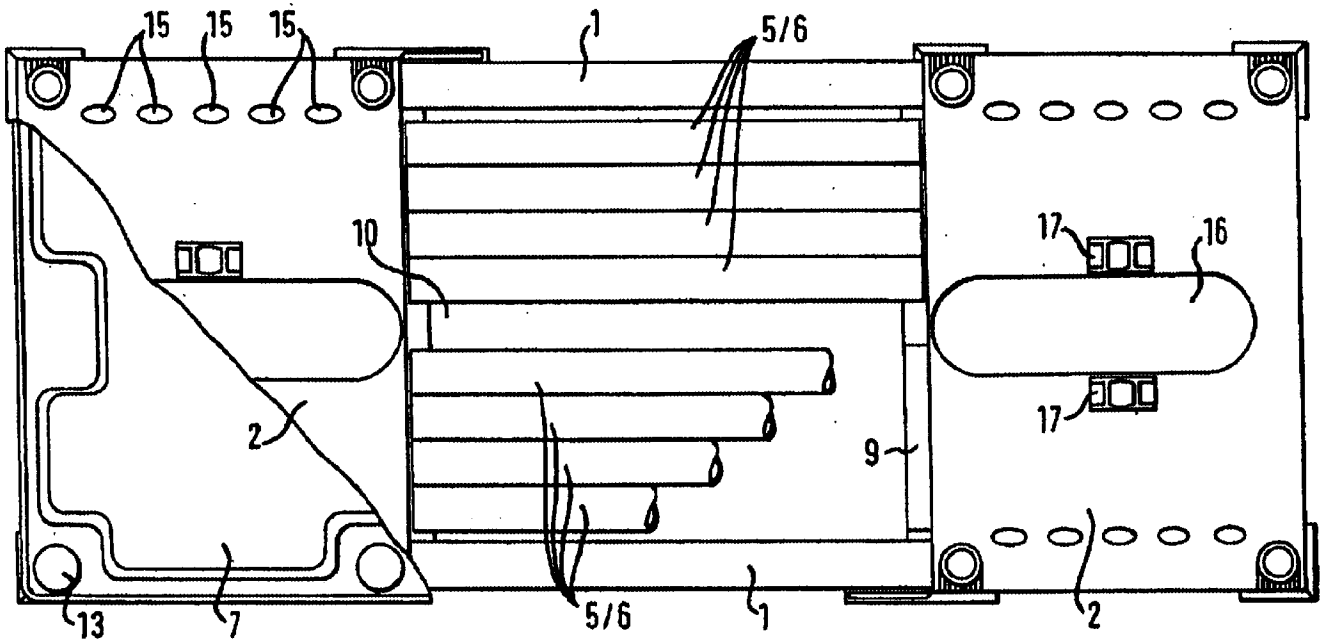
Figure 9:
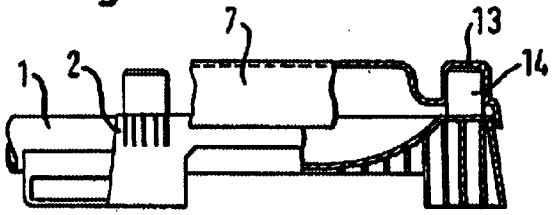
Figure 10:
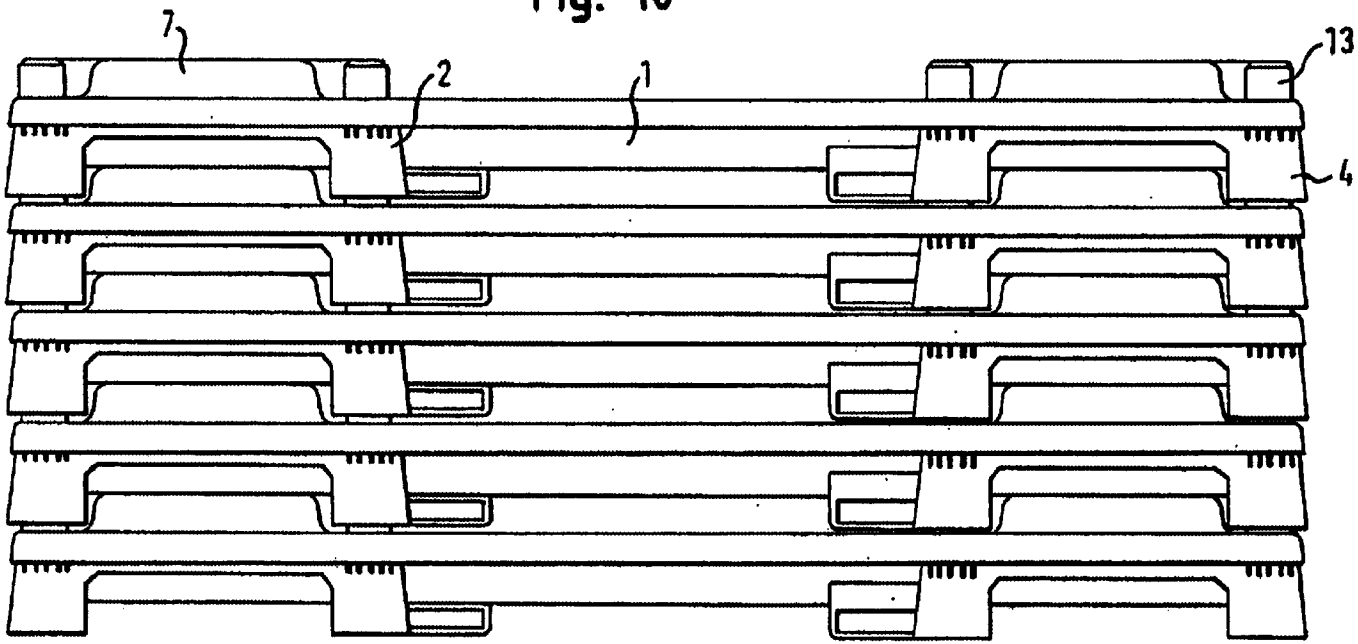
Figure 11B:
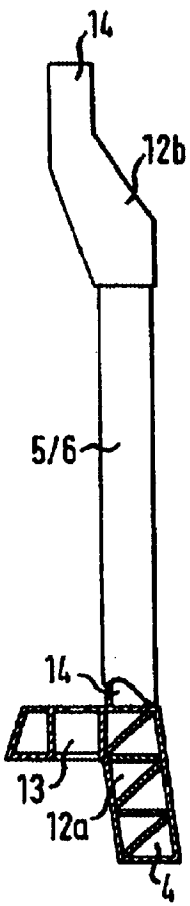
Figure 11A:
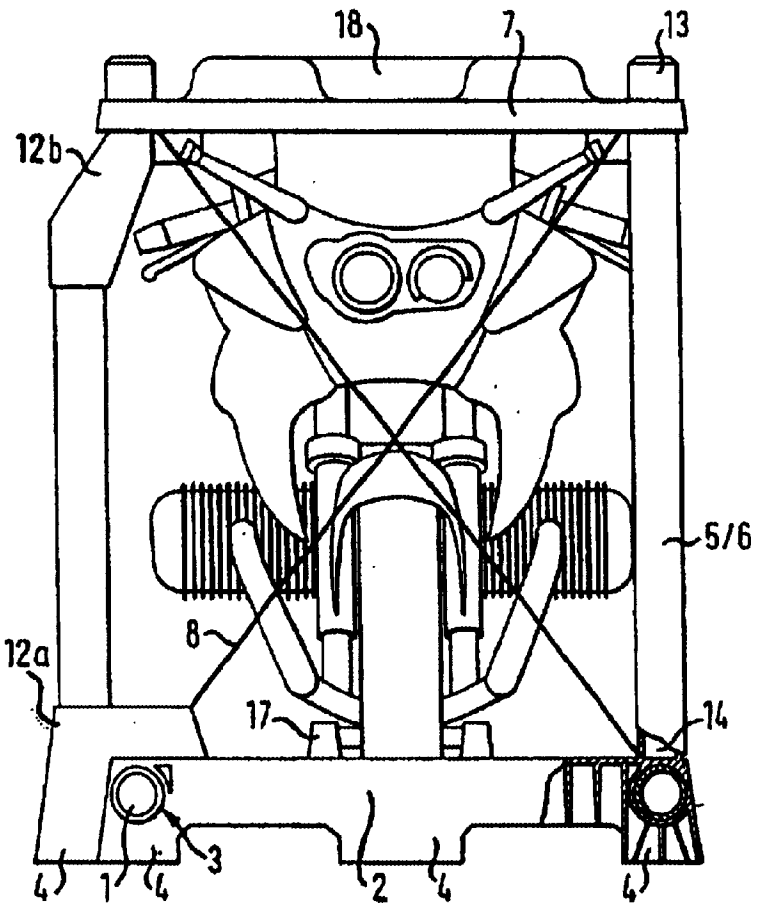

FIG. 6 the cover in a top view;

FIG. 7 the plastic base structure with the cover attached to it, and inserted columns, from the side;

FIG. 8 the plastic base structure with the cover attached to it, and inserted columns, in a top view;

FIG. 9 the plastic base structure with the cover attached to it;

FIG. 10 a stack of assembled transport containers;

FIG. 11*a* the transport container in a widened version, in a front view, with a detached widening;

FIG. 11*b* the detached widening in FIG. 11*a;*

Figure 12:
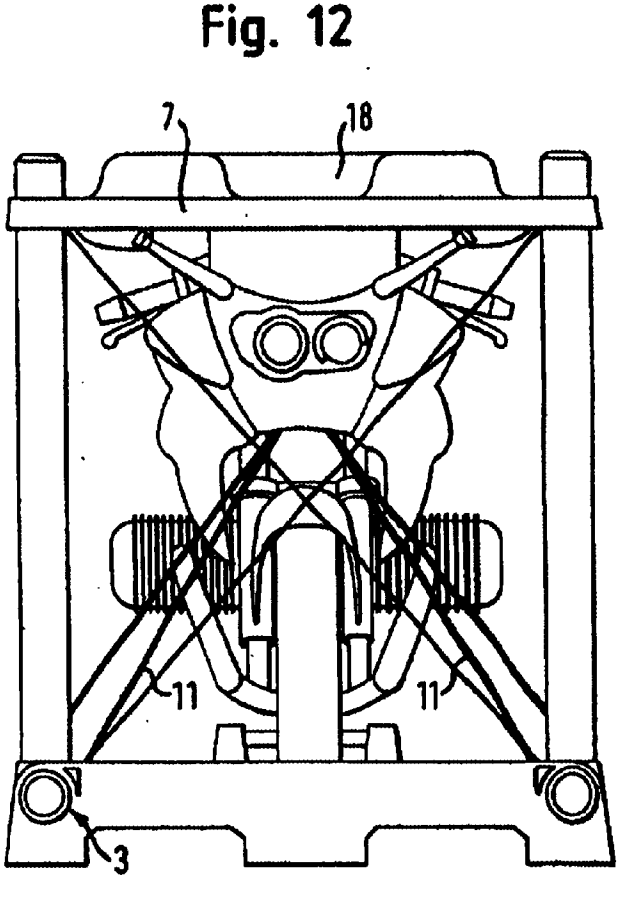
Figure 14:
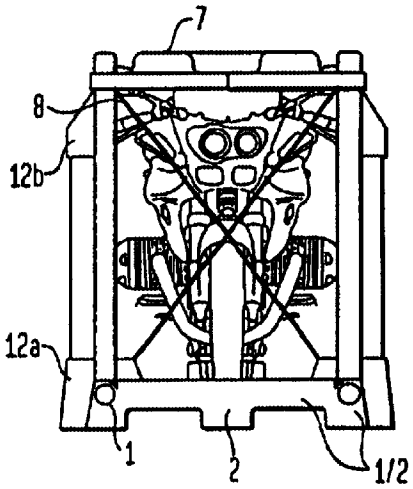
Figure 13:
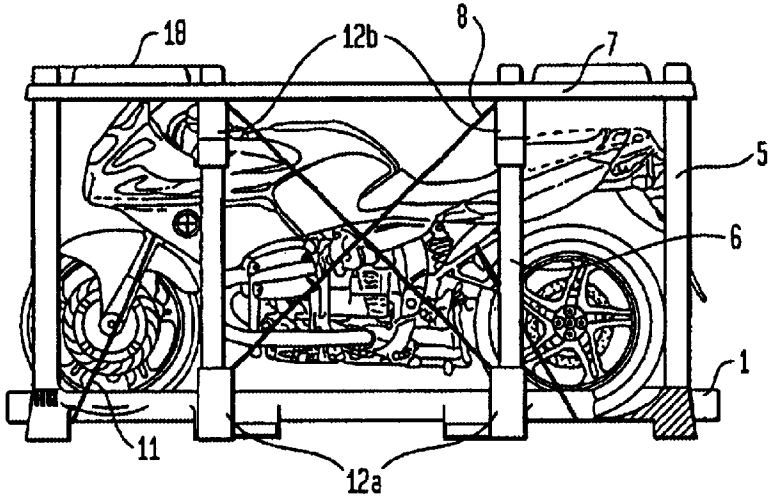
Figure 15:
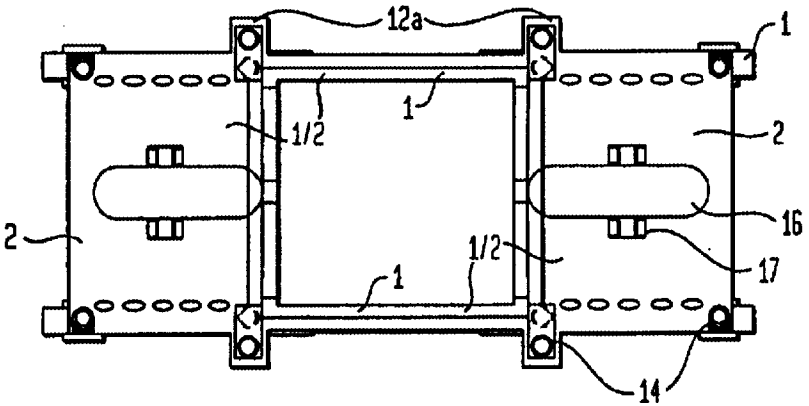
Figure 16:
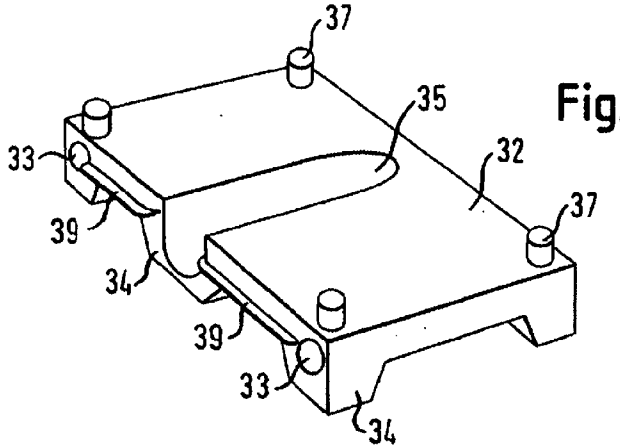
Figure 17:
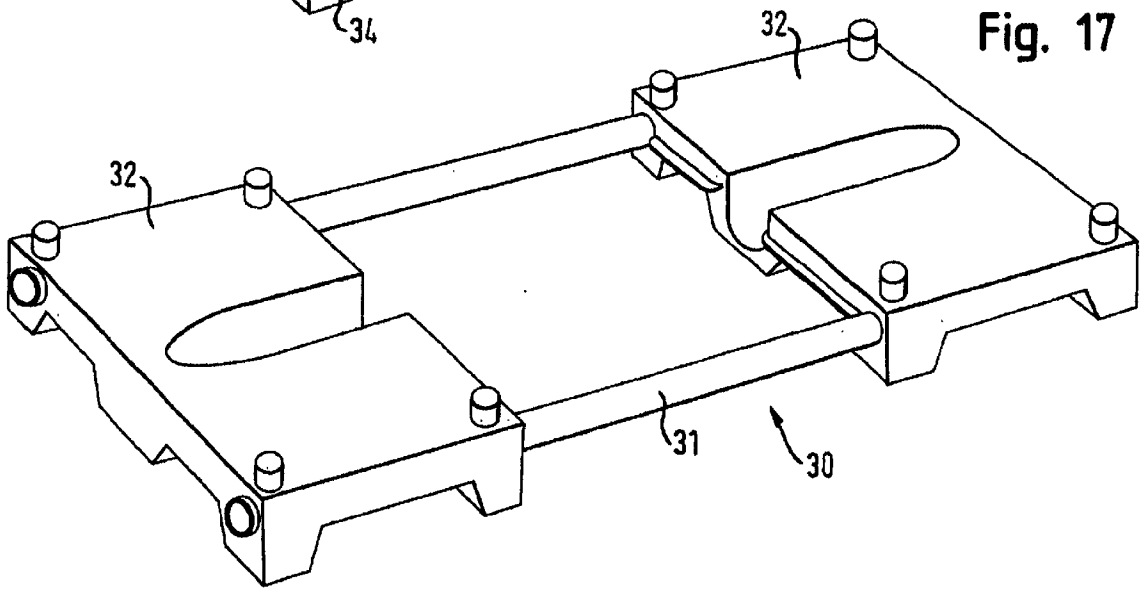
Figure 18:
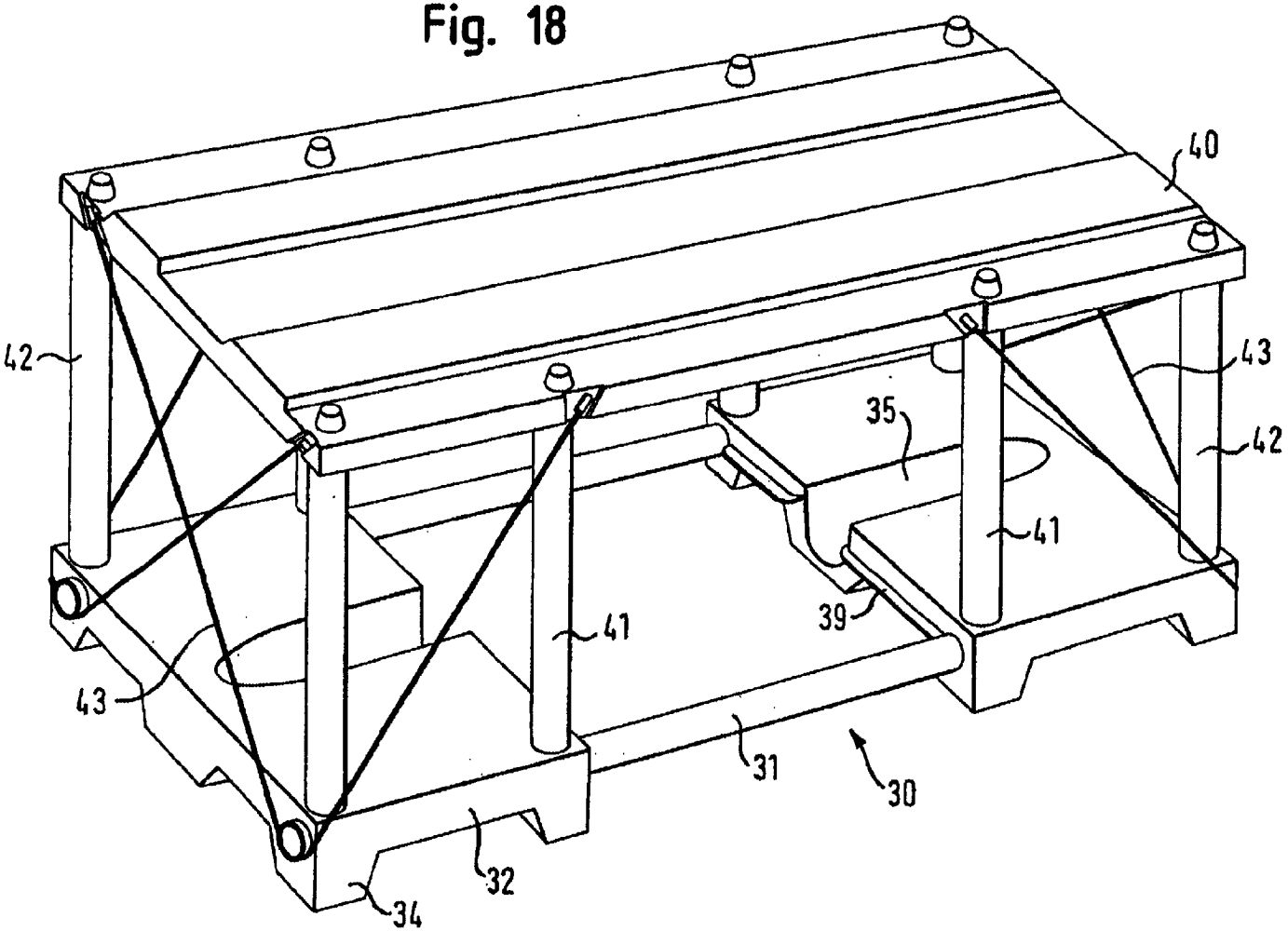
Figure 19:
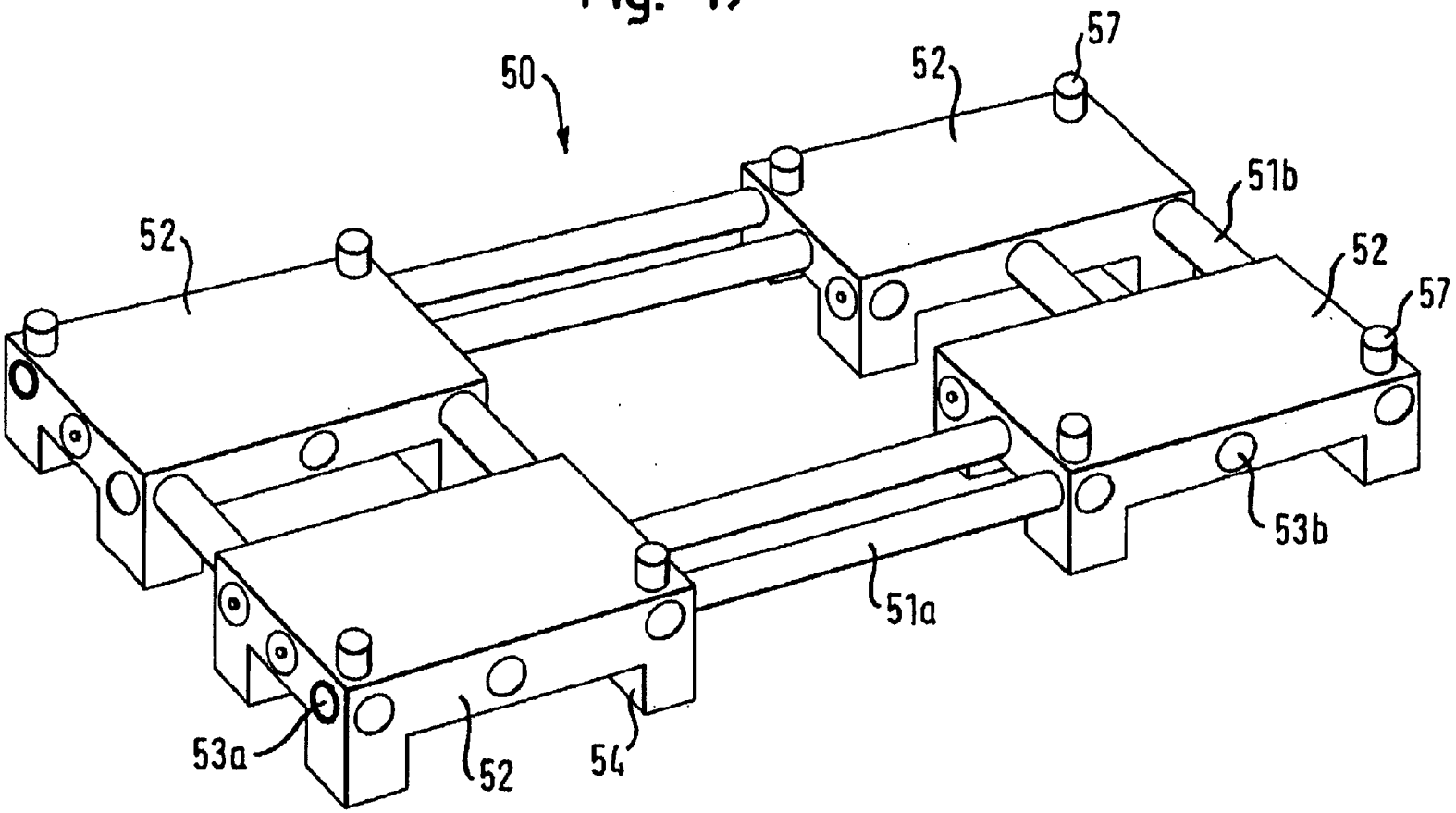

FIG. 12 the transport container in the basic version, in a front view;

FIG. 13 the widened transport container, in a side view;

FIG. 14 the transport container in the widened version, complete, in a front view;

FIG. 15 the widened plastic base structure in a top view;

FIG. 16 a modified foot element;

FIG. 17 a plastic base structure comprising two foot elements in accordance with FIG. 16;

FIG. 18 a transport container comprising a base which forms the plastic base structure in FIG. 17; and FIG. 19 another example embodiment of a plastic base structure.

FIG. 1 shows a side view of a transport container for motorcycles. The container is formed by a plastic base structure 1/2, a one-piece plastic cover 7, a plurality of columns 5 and 6 and a plurality of traction means 8 for tensing the individual parts forming the container. These individual parts form a latticework, i.e. the bracings and, in the connection areas, the nodes of the latticework, which for practicality can be thought of as being reduced to points. Overall, a transport container is obtained which has a low weight but sufficient resilience, in particular pressure-resilience and torsion-resilience.

The plastic base structure is a plastic pallet 1/2, consisting of two foot elements 2 and hollow profiles 1 pointing perpendicular to them. The hollow profiles are plastic extrusion profiles and in the example embodiment are embodied as smooth, round pipes. They primarily serve as connecting elements for a rigid and portative connection to the two foot elements 2. Each of the two foot elements 2 is formed in one plastic piece as an injection-moulded part. This type of primary moulding, which can as appropriate be replaced by mould-pressing, enables the foot elements 2 to be formed function-specifically, to fulfil a whole series of functions in one piece.

The transport container of the example embodiment is formed with eight columns 5 and 6, of which four can be seen in the side view 1. These are two outer columns 5 and two inner columns 6, which are of course provided on the opposite side of the transport container in the same number, form and arrangement. The columns 5 and 6 are formed identically and are provided with different reference numerals merely to distinguish between outer columns 5 and inner columns 6. The columns 5 and 6 are also plastic extrusion profiles which are continuously extruded and cut off to the desired length. In the example embodiment, the columns 5 and 6 are also round, smooth pipes.

The cover 7 is formed in one plastic piece by injection moulding. As appropriate, however, the cover 7 can also be obtained by mould-pressing or by a re-shaping process. By choosing such a re-shaping process and, with certain restrictions, when manufacturing it by re-shaping, the cover 7—like the foot elements 2—can be formed function—specifically, to fulfil a series of functions in one piece.

Each of the traction means 8, as the fourth basic element of the transport container, is a rope or belt, made for example of steel or preferably also made of plastic, and in particular can be elastic. Each of the traction means 8 comprises a fixing element at both its ends, for fixing to one of the foot elements 2 of the plastic pallet 1/2 and to the cover 7. Accordingly, fixing elements are also formed on the foot elements 2 and on the cover 7, to which the traction means 8 are fixed via their fixing elements. The traction means 8 are each tensioned. The traction means 8 tensed on the side of the transport container shown in FIG. 1 each extend diagonally in a frame formed by the plastic pallet 1, the cover 7 and the two inner columns 6, and intersect in the centre of the frame formed in this way. Traction means 8 are similarly tensed on the opposite side of the transport container. More precisely, the tensed traction means 8 extend from each upper connection area of one of the inner columns 6 and the cover 7 to a lower connection area of each of one of the inner columns 6 and the plastic pallet 1/2. In the four nodes of the latticework formed in this way, each of three bracings of the latticework converge, i.e. one of the traction means 8, one of the inner columns 6 and either the cover 7 as an upper bracing or the plastic pallet 1/2 as a lower bracing. The cover and the plastic pallet 1/2 are tensed towards each other by the tensed traction means 8, on the one hand via the columns 5 and 6 extending directly vertically between them, and also through the diagonally running traction means 8 themselves, such that a transport container with both high pressure-resilience and high torsion-resilience is obtained. Furthermore, it should be pointed out that a triangle is advantageously formed, respectively, by the latticework bracings 1/2, 6 and 8 on the one hand and the latticework bracings 6, 7 and 8 on the other.

The plastic pallet 1/2 is shown in different views in FIGS. 2, 3, and 4, and also individually in a partial section in the side view in FIG. 2. The foot elements 2 each comprise a plate-like area, on the lower side of which standing feet 4 are formed in the four corner areas and in the centre on the broadside, with releases remaining in between in order to obtain free spaces under the plate areas, into which a fork of a forklift truck can for example enter or another lifting means engage. Plug-in elements 14 for each of the columns 5 and 6 are formed on the upper side of the plate areas of each of the foot elements 2. The plug-in elements 14 are each formed by a neck-like attachment which protrudes up from the upper side perpendicularly, along the linear extension of the standing feet 4. Each of the plug-in elements 14 exhibits the form of a pipe socket with an outer cross-section which corresponds to the inner cross-section of the columns 5 and 6, in order to establish the connection with each of the columns 5 and 6 as a positive and simultaneously slightly frictional lock.

Furthermore, functional elements 15, 16 and 17 are formed on the upper side of the plate area of each of the foot elements 2. Thus, a wheel cavity 16 is let into the plate area of each of the foot elements 2, in the centre along a mid axis extending parallel to the hollow profile 1, and into which a wheel of a cycle, in the example embodiment a motorcycle, can enter some way, such as can already be seen from the rear wheel of the motorcycle in FIG. 1. A receptacle 17 for an axle, protruding on the longitudinal sides of the wheel cavity 16, is formed on both sides of the wheel cavity 16, said receptacle 17 comprising a semicircular recess on its upper side into which an axle fixed to the unit good to be transported can be Inserted. If the unit good to be transported is a cycle, then the front wheel of the cycle in particular can be dismantled for transport, and instead a so-called plug-in axle can be inserted through the then free front fork and the plug-in axle can be inserted into the semicircular recesses of the receptacles 17 for an axle.

Furthermore, a row of holes comprising a number of holes 15 is formed on both sides of the wheel cavity 16 on the upper side of the plate area of each of the foot elements 2. The rows of holes extend over the whole length of the foot element 2 in question between the adjacent plug-in elements 14 on the respective side, each separated uniformly. Each of the holes 15 forms a third functional element of the foot elements 2. The holes 15 serve as fixing points for lashing bracings 11 with which the unit good to be transported is lashed to the respective foot element 2. Two such lashing bracings are indicated in FIG. 1. In particular, however, the holes 15 serve as fixing points for the traction means 8. By forming the fixing points in the form of rows of holes, it is possible to vary how the lashing bracings 11 and the traction means 8 are fixed. Preferably, however, the traction means 8 are fixed via the innermost hole 15 of the respective row of holes, in each case; here, the innermost hole 15 is regarded as the hole which is nearest to the respective, opposite foot element 2.

As already mentioned, the two foot elements 2 are rigidly connected to each other by the hollow profiles 1. In the example embodiment, they are connected by two hollow profiles 1 which extend over the two longitudinal sides of the plastic pallet 1/2 and there, each protrude into the foot elements 2 via a jointing connection. The hollow profiles 1 protrude through the foot elements 2 below their plug-in elements 14 up until their respective outer sides and can protrude right through the foot elements 2, making it possible to extend the plastic pallet 1/2. It is in particular advantageous how the hollow profiles 1 form a reinforcement in the extension of the plug-in elements 14. The hollow profiles 1 therefore also assume a bearing function for the columns 5 and 6. The columns 5 and 6 are supported along a linear axis which extends through the plug-in elements 14, the central longitudinal axis of a hollow profile 1 and the standing feet 4. To obtain a firm seating for the hollow profiles 1 in the foot elements 2, through-bores extend through the foot elements 2 near the side rims. The hollow profile 1 and the bore nonetheless fit such that the hollow profiles 1 can be inserted into these bores completely, without the use of tools.

In a preferred embodiment, the jointing connection between the hollow profiles 1 and the foot elements 2 is in each case a detachable plug-in connection. In order to reinforce the compound, the hollow profiles 1 can instead or in addition be connected to the foot elements 2 in a material lock, in particular by welding or adhesion, which would however lose the option of varying the length.

Between two outer cover layers, of which the upper cover layer in particular forms the substantially smooth and closed surface, the foot elements 2 comprise a reinforcing ribbing and the pipe-like guides for the hollow profiles 1.

The cover 7 is shown in FIGS. 5 and 6 in a side view and in a top view. The cover 7 comprises a plate-like central area from which plug-in elements 13 protrude up according to the number of columns 5 and 6. Each of the plug-in elements 13 forms a hat-shaped receptacle for one of the columns 5 and 6 which can be accommodated in the plug-in elements 13 in a positive and slightly frictional lock. In the end areas either side of the central area, the cover 7 is cambered with respect to the central area, such that in the two end areas, the space available for the unit good is enlarged in terms of height up to the height of the plug-in elements 13. In the case of a motorcycle as a preferred unit good, the two cambers 18 created in this way provide space, for example, for the rear view mirrors of the motorcycle or for a motorcycle cover. The height of the transport container available for the unit good is thus optimally utilised, on the one hand downwards through the wheel cavities 16 and on the other hand upwards through the cambers 18. The central area of the cover 7, set back against the cambers 18 with respect to the height of the transport container, serves as a clamp for the columns 5 and 6 when the transport container is dismantled if, when dismantled, the cover 7 is attached directly to the plastic pallet 1/2, preferably via a plug-in connection.

FIGS. 7 and 8 show the transport container dismantled and amalgamated in its individual parts to save space. The columns 5 and 6 are inserted, adjacently and in parallel, into a space remaining free between the two hollow profiles 1 and the two foot elements 2. The columns 5 and 6 are arranged in parallel, closely adjacent, and parallel to the hollow profiles 1, and are each supported in the area of their two facing ends by a support 9 formed on the lower side of each of the foot elements 2 as its fourth functional element. In the example embodiment, a lower cover layer is formed in the longitudinal direction of the hollow profiles 1 on each of the foot elements 2, protruding over the top side of the foot element 2. Since the foot elements 2 are furthermore arranged in the plastic pallet 1/2 facing each other via their respective supports 9, said supports 9 are obtained for the columns 5 and 6. In the centre, however, between the adjacent columns 5 and/or 6, inner columns when assembled, a free space remains which extends from the one foot element 2 to the other in the extension of the two wheel cavities 16. This free space may be used as a navigation channel 10. The area formed by the columns 5 and 6 together with the navigation channel 10, which remains free in the centre, significantly facilitates unloading when transporting cycles. On the other hand, the free space enclosed like a frame by the hollow profiles 1 and the foot elements 2 facilitates fixing the cycle in the transport container when loading it, since the free space improves accessibility for a lifting means. This is in particular advantageous when one or both wheels of the cycle, in particular the front wheel, is dismantled and the corresponding wheel fork is supported by one of the two receptacles 17 for an axle.

The cover 7 attached to the plastic pallet 1/2 via the inserted columns 5 and 6 protects the upper side of the plastic pallet 1/2 and in particular its functional elements 15, 16 and 17 against contamination and damage. Furthermore, the loosely inserted columns 5 and 6 are lightly pressed against the supports 9 by the clamping function of the cover 7. The receptacles 17 for an axle, protruding upwards, come to rest in the two cambers 18 of the cover 7. The cover 7 fulfils its protective function by preferably being formed as a closed area.

The height of the assembled transport container merely corresponds to the height of the plastic pallet 1/2 plus the material thickness of the cover 7, essentially only the material thickness in the areas of the plug-in elements 13. In the example embodiment, the cover 7 exhibits the same material thickness all over. When attached to the plastic pallet 1/2, it circumferentially encompasses the pallet's upper outer rim, further contributing to the cover's protective function.

FIG. 10 shows a stack of a number of assembled transport containers, each of the assembled transport containers being as described by way of FIGS. 7 and 8. FIG. 9 merely shows this again. As is also clear from FIG. 10, the standing feet 4 of the foot elements 2 form receptacles for the plug-in elements 13 of the cover 7; preferably, the standing feet 4 form plug-in receptacles for the plug-in elements 13. In the stack, only the uppermost transport container requires its individual height as applies when it is assembled, while the assembled transport containers arranged below occupy an again significantly smaller height than they do individually when assembled, because the plug-in elements 13, including the plug-in elements 14 accommodated in them, are accommodated in the standing feet 4.

FIGS. 11*a*, 11*b*, 13 and 14 show a transport container which is widened in its central area. By locally widening the container, the specific space requirement, arising for example from the motorcycle shown, can be flexibly taken into account. The motorcycle, as an example of a preferred unit good, is protectively framed on all sides by the columns 5 and 6, the plastic pallet 1/2 and the cover 7.

The widening is formed using widening pieces 12*a* and 12*b*. The widening pieces 12*a* are inserted onto the foot elements 2 of the plastic pallet 1/2, and the widening pieces 12*b* are likewise each fixed to the lower side of the cover 7 by means of a plug-in connection. The plug-in elements 12*a* are angular, with a rim forming an inner edge, said rim being adapted to the side area and upper side of the foot elements 2 such that the widening piece 12*a*, when connected, abuts the corresponding upper areas of the foot elements 2 via its inner areas which define the inner edge area. In an upper limb of the angular profile, a plug-in element is formed for the plug-in connection with the foot element 2. Like the plug-in element 13 of the cover 7, the plug-in element of the widening piece 12*a* can be connected to each of the plug-in elements 14 of the foot element 2 by way of a plug-in connection, and is therefore likewise provided with the reference numeral 13. The other limb of the angular profile of the widening piece 12*a* forms a standing foot in the manner of the standing feet 4, and is therefore likewise provided with the reference numeral 4. When connected, the standing foot 4 of the widening piece 12*a* widens the respective standing foot 4 of the foot element 2 such that as a result the standing area of the foot element 2 is enlarged. Between its two cover layers, the angular profile comprises a ribbing in the manner of a latticework, and thus exhibits high stability for low weight. On the upper side of the angular profile, a further plug-in element 14 protrudes vertically up, serving as a plug-in connection to the columns 5 and 6. This plug-in element 14 corresponds to the plug-in elements 14 of the foot elements 2 and is therefore provided with the same reference numeral. The plug-in element 14 of the widening piece 12*a* perpendicularly extends the standing foot 4 formed by the widening piece 12*a*.

On its lower side, the other widening piece 12*b* forms the same plug-in element 13 as the cover 7, i.e. a plug-in receptacle for one of the columns 5 and 6. The upper end of the widening piece 12*b* can be inserted into the plug-in receptacle formed by the plug-in element 13 of the cover 7, like one of the plug-in elements 14 of the foot elements 2, and is accordingly likewise provided with the reference numeral 14. The two plug-in elements 13 and 14, or more precisely, the plug-in areas of the widening piece 12*b*, which extend in the longitudinal direction of the columns 5 and 6, offset with respect to each other by the degree of widening, are connected to each other by a central area pointing at an angle to them respectively, which benefits the resilience of the widening piece 12*b* with respect to the pressure forces to be accommodated and levers effective due to the widening.

Merely for the purpose of illustration, FIG. 11*b* shows a combination of one of the inner columns 6 and the two widening pieces 12*a* and 12*b*, detached from the compound of the transport container. The same combination is shown on the opposite side of the assembled transport container in FIG. 11*a*, together with the remaining components of the transport container. Merely for the purpose of comparison, FIG. 12 shows again the basic version of the transport container alongside the widened version.

FIGS. 13 and 14 show a side view and a front view of the widened version of the transport container, assembled and tensed. As can be seen from the figures, diagonal bracings are formed on the longitudinal sides of the transport container, between the two inner columns 6, and additionally on the front side and on the rear side of the transport container, between the two front columns 5 and the two rear columns 5.

Lastly, FIG. 15 shows a top view of the plastic pallet 1/2 comprising four attached widening pieces 12*a* in total. With respect to the widening pieces 12*a* and 12*b*, reference is made to the fact that the stability of the transport container, in particular the stability of the plastic pallet, is not weakened by the widening pieces 12*a* and 12*b* being purely additional pieces which can be inserted onto the existing basic-version structure.

Furthermore, it can also be seen from the figures for the widened version that the transport container can also be extended with respect to the basic version without forfeiting on stability. For the purpose of extending, the hollow profiles 1 are longer by the excess "x" as compared to the basic version and each protrude beyond the two foot elements 2 by half the excess "x". Therefore, for extending the transport container, the foot elements 2 can in total be extended on the hollow profiles 1 by the excess "x", without diminishing the support function of the hollow profiles 1. The bending-resilience of the plastic pallet 1/2 is also substantially maintained over the full length of the extended plastic pallet 1/2. Extending does of course reduce the bending-resilience slightly. However, despite the extension, the full guiding and supporting length of the hollow profiles 1 within the foot elements 2 is advantageously maintained, since even after extending, the hollow profiles 1 extend under the columns 5 and 6 supported laterally by the respective foot element 2, and continue to perform the support function for the two columns 5 and 6.

FIG. 16 shows a three-dimensional representation of a single foot element 32, simplified as compared to the foot element 2 of the first example embodiment. FIG. 17 likewise shows a three-dimensional representation of the plastic pallet 30, assembled from two foot elements 32 in accordance with FIG. 16 and two hollow profiles 31. The hollow profiles 31 correspond to those of the first example embodiment. The foot element 32 comprises, as its functional elements, the groove 35 which serves as a wheel cavity, the support 39 and, in the area of its four corners, the four plug-in elements 37 protruding from its upper side. The receptacles 33 for the hollow profiles 31 are also clearly to be seen. Furthermore, the embodiment of the groove 35 as a channel extending in the longitudinal direction of the hollow profiles 31 can clearly be seen in the three-dimensional representation in FIG. 16, said channel terminating in the foot element 32 and extending as far as the side facing the other foot element 32 of the pallet, such that a cycle to be transported can very easily enter the groove 35. In order to form the groove 35, the middle standing foot 34 on the foot element 32 is formed in the manner of a trough.

FIG. 18 shows a transport container for cycles, in particular motorcycles, in which the plastic pallet 30 of FIG. 17 forms the base. In order to obtain ways of fixing the traction means 43, the hollow profiles 31 are inserted into the two foot elements 32 until they protrude a little way over their two outer sides. The traction means 43 are each fixed via their two ends to the plastic lid 40 and, tensioned, are pulled via the protruding ends of the hollow profiles 31, i.e. they are pulled diagonally from a first connection area of the lid 40 to one of the outer columns 42 to a connection area of the plastic pallet 30 to an adjacent column, i.e. the freely protruding end of one of the hollow profiles 31, and by looping the free end, guided from there to another connection area which the lid 40 forms with the next-inner column 41, where it is fixed. In the case of the foot elements 32 of the base structure of this example embodiment, therefore, forming particular fixing elements can be omitted.

FIG. 19 shows a plastic pallet 50 obtained by adjacently arranging two basic pallets, each comprising two foot elements 52 and hollow profiles 51*a*, and connecting them to each other with the aid of further hollow profiles 51*b*. What has been said with respect to the foot elements and hollow profiles of the other example embodiments applies similarly with respect to manufacturing the foot elements 52 and hollow profiles 51*a* and 51*b* and to their basic properties. What has been said with respect to the other example embodiments also applies to the jointing connections. The foot elements 52 differ from the foot elements 2 and 32 of the other example embodiments substantially in that they are formed not only with receptacles 53*a* for the hollow profiles 51*a* but in addition also with receptacles 53*b* for the hollow profiles 51*b*. The receptacles 53*a* correspond to the receptacles 3 and 33 of the other example embodiments. The receptacles 53*b* differ from the receptacles 53*a* only in their orientation, in that the central longitudinal axes of the receptacles 53*b* each point at right angles to the central longitudinal axes of the receptacles 53*a*, giving rise to the way of extending perpendicular to the hollow profiles 51*a*, as shown in FIG. 19. The foot elements 52 are furthermore fitted with plug-in elements 57 corresponding to the plug-in elements 37 of the second example embodiments in order to be able to attach the columns.

What is claimed is:

1. A transport container for unit goods, comprising:

a) a plastic base structure forming a base of said container;

b) a plastic cover;

c) columns borne by said plastic base structure and bearing said plastic cover, and which are connected in a positive lock to the plastic base structure and the plastic cover;

d) and traction means which tense the plastic base structure and the plastic cover against said columns.

2. The transport container as set forth in claim 1, wherein said traction means are fixed to the plastic cover.

3. The transport container as set forth in claim 1, wherein said traction means are fixed to the plastic base structure.

4. The transport container as set forth in claim 1, wherein the plastic base structure, the plastic cover, the columns and the traction means are bracings of a latticework, and in that one of the columns, one of the traction means and either the plastic base structure or the plastic cover converge at nodes of said latticework.

5. The transport container as set forth in claim 1, wherein the plastic base structure is a plastic pallet and in that plastic hollow profiles and plastic foot elements extending perpendicular to said hollow profiles form part or all of the plastic base structure, wherein the hollow profiles and foot elements are connected to each other by means of jointing connections.

6. The transport container as set forth in claim 5, wherein the follow profiles of the plastic base structure are plastic extrusion profiles.

7. The transport container as set forth in claim 1, wherein the columns are plastic extrusion profiles.

8. The transport container as set forth in claim 5, wherein the hollow profiles extend below the columns, such that the columns are also supported on the hollow profiles.

9. The transport container as set forth In claim 1, wherein the plastic base structure comprises foot elements formed in one plastic piece in a primary moulding process.

10. The transport container as set forth claim 9, wherein said foot elements are injection moulded parts.

11. The transport container as set forth in claim 1, wherein the plastic base structure is formed in one plastic piece in a primary moulding process.

12. The transport container as set forth claim 11, wherein the plastic base structure is an injection moulded part.

13. The transport container as set forth in claim 1, wherein the plastic base structure forms a surface on its upper side which is interrupted only by functional elements and is otherwise smooth.

14. The transport container as set forth in claim 1, wherein the plastic base structure comprises free standing standing feet and in that the columns are supported on the plastic base structure in a perpendicular extension of said standing feet.

15. The transport container as set forth in claim 1, wherein a number of fixing elements for the traction means are formed or fixed on the plastic base structure and/or on the plastic cover between adjacent columns, in order to be able to tense the traction means at different angles of inclination with respect to the plastic base structure and plastic cover.

16. The transport container as set forth in claim 1, wherein plug-in elements are formed on the upper side of the plastic base structure and on the lower side of the plastic cover, for a plug-In connection to the columns.

17. The transport container as set forth in claim 16, wherein said plug-in elements are arranged and formed such that the plastic cover can be attached directly to the plastic base structure or also vice versa, wherein the plug-in elements of the plastic cover and the plug-in elements of the plastic base structure engage with each other, to farm a plug-in connection.

18. The transport container as set forth in claim 1, wherein at least a first widening piece is detachably fixed to the plastic cover and at least a second widening piece is detachably fixed to the plastic base structure, and in that one of the columns is connected to each of said first widening piece and said second widening piece in a positive lock and in a frictional lock, via a plug-in connection.

19. The transport container as set forth in claim 18, wherein the first widening piece is supported on an upper side of the plastic structure, facing the plastic cover, and forms a standing foot for additionally supporting the first widening piece of a base.

20. The transport container as set forth in claim 19, wherein the first widening piece additionally abuts a side area of the plastic base structure.

21. The transport container as set forth in claim 18, wherein the second widening piece is supported on a lower side of the plastic cover facing the plastic base structure.

22. The transport container as set forth in claim 18, wherein the first widening piece forms a plug-in element for a plug-in connection to a plug-in element of the plastic base structure, and in that the second widening piece also forms a plug-in element for a plug-in connection to a plug-in element of the plastic cover.

23. The transport container as set forth in claim 1, wherein a wheel cavity for a cycle to be transported is formed on an upper side of the plastic base structure.

24. The transport container as set forth in claim 1, wherein at least one receptacle for an axle is formed or fixed on an upper side of the plastic base structure, said receptacle serving to accommodate an axle fixed on a unit good to be transported.

25. The transport container as set forth in claim 1, wherein first cambers are formed in the plastic cover near rims of the plastic cover, and in that each of the columns protrudes into one of said first cambers.

26. The transport container as set forth in claim 25, wherein at least one second camber is formed in the plastic cover in order to locally enlarge holding space framed by the transport container, in terms of height.

27. The transport container as set forth in claim 1, wherein said transport container serves as a cycle transport container.

28. The transport container as set forth in claim 1, wherein the traction means are fixed in each of a first connection area of one of the columns to the plastic base structure and a second connection area of another of the columns to the plastic cover, in order to tense the plastic base structure and the plastic cover against the columns.

* * * * *